US006998379B1

(12) United States Patent
Costagliola

(10) Patent No.: US 6,998,379 B1
(45) Date of Patent: Feb. 14, 2006

(54) BLEACH AND VINEGAR DETERSIVE SYSTEM

(76) Inventor: Aniello Costagliola, 29290 Corbin Pkwy., Easton, MD (US) 21601

( * ) Notice: Subject to any disclaimer, the term of this patent is extended or adjusted under 35 U.S.C. 154(b) by 0 days.

(21) Appl. No.: 10/762,320

(22) Filed: Jan. 23, 2004

(51) Int. Cl.

| | |
|---|---|
| ***C11D 3/00*** | (2006.01) |
| ***C11D 7/18*** | (2006.01) |
| ***C11D 3/395*** | (2006.01) |
| ***C11D 15/00*** | (2006.01) |

(52) U.S. Cl. ..... 510/372; 510/461

(58) Field of Classification Search ..... 510/367, 510/370, 372, 375, 376, 379, 380, 381, 461
See application file for complete search history.

(56) References Cited

U.S. PATENT DOCUMENTS

| | | | |
|---|---|---|---|
| 4,164,477 | A | 8/1979 | Whitley |
| 4,793,942 | A | 12/1988 | Lokkesmoe et al. |
| 5,436,008 | A | 7/1995 | Richter et al. |
| 5,643,861 | A | 7/1997 | de Guertechin et al. |
| 6,423,674 | B1 | 7/2002 | Williams et al. |

*Primary Examiner*—Michael Barr
*Assistant Examiner*—John M Petruncio
(74) *Attorney, Agent, or Firm*—Robert M. DeWitty; Outsource Product Manufacture LLC

(57) ABSTRACT

A detersive system containing surfactants, vinegar, bleach and alternatively emollients, foaming agents, perfumes, and builders has been developed. Due to the addition of both bleach and vinegar, the detersive system shows synergistic activity with regards to necessary areas and objects of cleanliness that can be found in restaurants and eating establishments. In addition to the synergistic activity, the formulation does not release harmful chloramine gas that is usually present when vinegars and bleach are mixed.

15 Claims, No Drawings

BLEACH AND VINEGAR DETERSIVE SYSTEM

BACKGROUND OF THE INVENTION

In public restaurants, cleanliness is considered a pillar of restaurant maintenance. Reasons include stopping the spread of bacteria that can lead to foodbourne diseases. According to the Partnership for Food Safety Education, necessary areas and objects of focus for cleanliness include cutting boards, knives, utensils, countertops, stainless steel counters, walls, windows, appliances, ovens, stove tops, burners, pots, pans, stove hoods, and vents. The various necessary areas and objects of focus for cleanliness listed previously are many times subject to "oily soil" stains. Oily soil refers to petroleum products, such as vegetable oil, that can be the cause of stains in restaurants.

Current methods and means for addressing oily soils include liquid aqueous synthetic organic detergent compositions that can be used for hand washing of dishes and hard surfaces. The liquid detergent compositions usually comprise anionic, cationic and/or nonionic surfactants, builders and adjuvants. The liquid detergent compositions can serve to emulsify the oily soils in aqueous media. Liquid detergent compositions can also contain enzymes which are useful for hydrolysis of triglycerides, proteins, and starch. In the art, it is taught that oily soil is removed by the combined action of surfactants and enzymes. Builders usually include zeolite and phosphate.

The removal of oily soil from necessary objects and areas in a restaurant more than likely occurs via three mechanisms: (1) roll-up, (2) emulsification, or (3) solubilization. In Roll-up mechanism, the oily soil is reduced when the contact angle is larger than 90°. In Emulsification mechanism, a low-interfacial tension between the oily soil and detergent solution is required. In Solubilization mechanism, the oily soil is solubilized into an in situ formed microemulsion. It is generally held that Roll-up, being related to wetting agents, is relatively simple to achieve, and Emulsification and Solubilization require fine tuning of the composition.

Detersive systems have also been employed in the cleaning of necessary objects and areas in restaurants. Detersive systems are concentrates comprising mixtures of cleaning ingredients that, when mixed with water, form a cleaning medium or use compositions. Detersive systems can be in the form of a liquid, a particulate, or a solid.

The Encyclopedia of Chemical Technology discussing the use of single and combination ingredient detersive systems and their suitable uses, for example for glass and ceramics by hand (hand dishwashing) that may control oily soil and solid organic material, an organic surfactant is suitable with a mechanical action of moderate to vigorous; for cleaning metal structures and equipment, tanks, etc. that contains mostly oily soil and some organic solid material, and inorganic surfactant worked by suitable with a mechanical action of vigorous rubbing, sometimes hydraulic.

The prior art teaches inventions that show the use of detersive systems for cleaning. U.S. Pat. No. 4,793,942 to Lokkesmoe et al. teaches the use of a detersive agent containing a soil removing detergent and a softening agent having an inner acidic aqueous phase and an exterior organic complexing agent phase. U.S. Pat. No. 5,643,861 to de Guertechin et al. teaches a cleaning composition containing a bleachant system incorporated in three liquid phases, wherein each phase essentially contains a polar solvent, a non-polar solvent, or a weakly polar solvent and an amphiphile.

The use of bleaching agents in cleaning composition is well-known in the art. In warewashing, the primary role of bleach is to reduce spotting and filming by breaking down and removing the last traces of absorbed soils. U.S. Pat. No. 4,793,942 teaches the incorporation of sources of active chlorine, including sodium hypochlorite, calcium hypochlorite, and chlorinated sodium tripolyphosphate. U.S. Pat. No. 5,643,861 discusses the inclusion of a peroxygen bleach. U.S. Pat. No. 4,164,477 to Whitley teaches a detergent containing cleaning additives, and the option to include a bleach such as calcium hypochlorite, sodium hypochlorite or hydrogen peroxide.

Vinegar is the liquid condiment or food flavoring used to give a sharp or sour taste to foods. It is also used as a preservative. Vinegar consists principally of water, acetic acid, mineral salts, and the organic constituents of the natural organic starting material.

The percentage of acetic acid in vinegar usually consists of 3 to 5%. Regarding cleaning compositions, acetic acid and vinegar have been incorporated in some instances. U.S. Pat. No. 4,164,477 teaches the incorporation of vinegar into a mold or mildew remover concentrate. U.S. Pat. No. 4,793,942 teaches the incorporation of an acid such as acetic acid into the composition. U.S. Pat. No. 5,436,008 teaches the incorporation of acidulants such as acetic acid.

Regarding the use of bleach with acetic acid or vinegar, it is well-known in the art of cleaning that bleach and acetic acid or vinegar should not be mixed. The mixture of bleach with vinegar has, prior to this invention, resulted in the release of highly toxic chloramine gas. It is known that short-term exposure to this gas can result in mild asthmatic symptoms, or serious respiratory problems.

The instant invention relates to a detersive system that, in addition to containing various cleaning ingredients, contains a bleach and vinegar that creates a synergistic affect useful in the cleaning of necessary areas and objects of focus for cleanliness in restaurants. Additionally, the detersive system of the instant invention can be used in the cleaning of many different surfaces including stainless steel, Formica™, chrome, glass, plastic, and carpet. The detersive system of the instant invention is also effective against oily soil stains. The invention also relates to a method of making such a detersive system containing a bleach and vinegar, while avoiding the release of toxic amounts of harmful chloramine gas.

SUMMARY OF THE INVENTION

This invention relates to a detersive system containing a surfactant, bleach, vinegar, water, and alternatively, emollients, foaming agents, perfumes, and builders, for the cleaning of necessary areas and objects of focus for cleanliness.

Accordingly, it is one object of the present invention to provide a detersive system that is created by a synergistic activity between the bleach and vinegar, such that cleaning properties of the detersive system is improved.

It is another object of the present invention to provide a detersive system containing a bleach and vinegar while avoiding the release of a toxic amount of gas.

It is still further another object of this invention to provide a detersive system that is useful on cleaning oily soils that may be present in restaurant and non-restaurant areas.

Other objects of this invention will become apparent from time to time throughout the specification and claims as related herewith.

DESCRIPTION OF THE INVENTION

Detersive systems are concentrates comprising mixtures of cleaning ingredients that when mixed with water form a cleaning medium. The detersive system suitable for the instant invention can include, but is not limited to, surfactants, a bleach, vinegar agents, builders, enzymes, foaming agents, emollients, antiredeposition agents, solvents, hydrotropes, fluorescers, foam boosters, foam controllers, sodium carbonate, sodium bicarbonate, sodium silicate, sodium sulphate, calcium chloride, and perfumes. In a preferred embodiment, the detersive system consists of surfactants, a bleach, vinegar, emollients, builders, and foaming agents. The detersive system can be in solid, particulate, or liquid form concentrate, most preferably in liquid form concentrate.

Surfactants

Nonionic, anionic and/or cationic surfactants may be used in the instant composition, individually, or two or more in combination. Examples of such include sodium or potassium salts of fatty acids, rosin acids, and fall oil; alkylanene sulfonates such as propylene tetramerbenzene sulfonate; alkyl sulfates or sulfonates including both branched and straight-chain hydrophones as well as primary and secondary sulfate groups; sulfates and sulfonates containing an internal linkage between the hydrophobic and hydrophilic groups such as taurides and sulfonated fatty mono-glycerides, long chain acid esters of polyethylene glycol; polyalkylene glycol esters of alkyl phenols wherein the alkylene group is derived from ethylene or propylene oxide or mixtures thereof; polyalkylene glycol esters of long chain alcohols or mercaptans, fatty acul diethanolamides; block copolymers of ethylene oxide and propylene oxide. Nonionic surfactants include C5-12 alkyl phenol ethoxylates and/or propylates, EO/PO block copolymers, or mixtures thereof. Specific examples of surfactants include sodium octyl sulfate, sodium 2-ethyl hexyl sulfate, sodium actul decul sulfate, sodium decyl sulfate, sodium lauryl sulfate, sodium laureth sulfate, disodium lauryl sulfosuccinate, disodium laureth sulfosuccinate, ammonium lauryl sulfate, ammonium laureth sulfate, triethanolamine lauryl sulfate, triethanolamine laureth sulfite, monoethanolamine lauryl sulfite, monoethanolamine laureth sulfate, potassium lauryl sulfate, potassium laureth sulfate, magnesium lauryl sulfate, magnesium laureth sulfate, sodium nonyl phenol ether sulfate, sodium alph-olefin sulfonate, ethylene glycol monostearate, and ethylene glycol disterate.

Suitable surfactants also include commercially available detergents. Commercially available detergents refer to detergents that are manufactured and available on the marketplace. For the instant invention, a commercially available detergent generally comprises a anionic, cationic, and/or nonionic surfactants, builders, emollients, water, and foaming agents. An example of a suitable commercially available detergent is Silky Pink™ hand dishwash detergent, available from Carroll Company, Garland Tex. The ingredients of Silky Pink™ include sodium lauryl sulfate (surfactant), water, dodecylbenzene sulfonic acid (sodium salt) (builder), urea (emollient), cocoamide DEA (foaming agent).

Surfactants can be used in an amount of from about 50 to about 80 weight percent, more preferably from about 60 to about 75 weight percent, and most preferably from 70 to about 73 weight percent.

Bleach

Bleaching compounds are suitable for use in cleaning hard surfaces as well as dishware. The primary role of bleach in dishware washing is to reduce the spotting and filming by breaking down and removing the last traces of absorbed soils. In the instant invention, suitable bleaching compounds include chlorine, sodium hypochlorite, calcium hypochlorite, bleach liquor, lime bleach liquor, bleaching powder, chlorinated lime, chloride of lime, dibasic magnesium hypochlorite, lithium hypochlorite, chlorinated trisodium phosphate, hypochlorous acid, oxidized chlorides, hypobomites, chlorinated isocyanurates, halogenated hydantoins, sodium N-chlorobenzenesulfonamide, sodium N-chloro-p-toluenesulfonamide, N-chlorosuccinimide, trichloromelamine, 1,3-dichlorotetrahydroquinazoline-2,4-dione, tetrachloroglycoluril, sodium trichlorometaphosphimate, sodium N-chloroimido-disulfonate, and N-chlorophenylbiquanidino, chlorine dioxide, hydrogen peroxide, sodium perborate, sodium carbonate peroxyhydrate, peroxymonosulfuric acid (Caro's Acid), and potassium permonosulfate. In a preferred embodiment, sodium percarbonate is used as the bleach compound in the detersive system of the instant invention. The bleach compound in the system can be used in an amount of from about 0.010 to about 6 weight percent, more preferably from about 0.020 to about 4 weight percent, and most preferably from about 0.022 to about 2 weight percent. Bleach compounds may be used individually, or two or more in combination.

Vinegar

Vinegar is considered a sharp or sour wine that consists primarily of water, acetic acid, mineral salts, and organic constituents. Vinegar results from the action of the enzymes of bacteria of the genus Acetobacer, and from the dilute solutions of ethyl alcohol. Primary sources of vinegar include fruits, honey, barley malt, and rice. In the instant invention, suitable vinegar may be derived from the sources of jujube, sweet potato, dates, citrus, persimmon, pear, sugar cane, plum, tomato, kiwi fruit, pineapple, molasses honey, palm sap, muscavado, potato, soybean, seaweed, rice, grain, startch, onions, bamboo grass, wood, whey, coconut water, and vinasse. Commercially available types of vinegar that are suitable for the detersive system of the invention include cider vinegar, apple vinegar, white vinegar, malt vinegar, sugar vinegar, glucose vinegar, or spirit vinegar. Vinegars may be used individually, or two or more in combination. More preferably, the detersive system contains white vinegar, cider vinegar, and/or apple vinegar. Most preferably, the detersive system contains white vinegar. The vinegars can be used in an amount of from about 10 to about 20 weight percent, more preferably from about 15 to about 18 weight percent, and most preferably from about 16 to about 17 weight percent.

Emollients

Emollients may be included in the detersive system of the instant invention to provide a "softening feeling" to the skin of users of the instant invention. Suitable emollients can include, for example, urea, mineral oil, petrolatum, and isocetyl stearyl stearate. Emollients can be used individually or in combination.

Foaming Agents

Foaming agents can be contained in the detersive system of the invention. Suitable agents include cocoamide diethanolamide (DEA), cocoamide monoethanolamide (MEA), cocoamide triethanolamide (TEA), lauramide DEA, lauramide MEA, lauramide TEA, polysorbate 20, polysorbate 60, polysorbate 80, ammonium or alkaline salts of sulphated aliphatic alcohols, ammonium or alkaline slats of sulfated aliphatic ethoxylated alcohols, cocoamide derivatives, lauramide derivatives, and/or ehtoxylate aliphatic phenolics. Foaming agents can be used individually, or two or more in combination.

Perfumes

Suitable perfumes that can be contained in the detersive system include, acetyl cedrene; 4-acetoxy-3-pentyltetrahydropyran; 4-acetyl-6-t-butyl-1,1-dimethylindane, available under the trademark "CELESTOLIDE"; 5-acetyl-1,1,2,3,3,6-hexamethylindane, available under the trademark "PHANTOLIDE"; 6-acetyl-1-isopropyl-2,3,3,5-tetramethylindane, available under the trademark "TRASEOLIDE"; alpha-n-amylcinammic aldehyde; amyl salicylate; aubepine; aubepine nitrile; aurantion; 2-t-butylcyclohexyl acetate; 2-t-butylcyclohexanol; 3-(p-t-butylphenyl)propanal; 4-t-butylcyclohexyl acetate; 4-t-butyl-3,5-dinitro-2,6-dimethyl acetophenone; 4-t-butylcyclohexanol; benzoin siam resinoids; benzyl benzoate; benzyl acetate; benzyl propionate; benzyl salicylate; benzyl isoamyl ether; benzyl alcohol; bergamot oil; bornyl acetate; butyl salicylate; carvacrol; cedar atlas oil; cedryl methyl ether; cedryl acetate; cinnamic alcohol; cinnamyl propionate; cis-3-hexenol; cis-3-hexenyl salicylate; citronella oil; citronellol; citronellonitrile; citronellyl acetate: citronellyloxyacetaldehyde; cloveleaf oil; coumarin; 9-decen-1-ol: n-decanal; n-dodecanal; decanol; decyl acetate; diethyl phthalate; dihydromyrcanol; dihydromyrcenyl formate; dihydromyrcenyl acetate; dihydroterpinyl acetate; dimethylbenzyl carbinyl acetate; dimethylbenzylcarbinol; dimethylheptanol; dimyrcatol; diphenyl oxide; ethyl naphthyl ether; ethyl vanillin; ethylene brassylate; eugenol; geraniol; geranium oil; geranonitrile; geranyl nitrile; geranyl acetate; 1,1,2,4,4,7-hexamethyl-6-acetyl-1,2,3,4-tetrahydronaphthalene, available under the trademark "TONALID"; 1,3,4,6,7,8-hexahydro-4,6,6,7,8,8-hexamethylcyclopenta-2-benzopyran, available tinder the trademark "GALAXOLIDE"; 2-n-heptylcyclopentanone; 3a,4,5,6,7,7a-hexahydro-4,7-methano-1 (3)H-inden-6-ylpropionate, available under the trademark "FLOROCYCLENE"; 3a,4,5,6,7,7a-hexahydro-4,7-methano-1 (3)H-inden-6-ylacetate, available under the trademark "JASMACYCLENE"; 4-(4'-hydroxy-4'-methylpentyl)-3-cyclohexenecarbaldehyde; alpha-hexylcinammic aldehyde; heliotropin; Hercolyn D; hexyl aldone; hexyl cinnamic aldehyde; hexyl salicylate; hydroxycitronellal; i-nonyl formate; 3-isocamphylcyclohexanol; 4-isopropylcyclohexanol; 4-isopropylcyclohexyl methanol; indole; ionones; irones; isoamyl salicylate; isoborneol; isobornyl acetate; isobutyl salicylate; isobutylbenzoate; isobutylphenyl acetate; isoeugenol; isolongifolanone; isomethyl ionones; isononanol; isononyl acetate; isopulegol; lavendin oil; lemongrass oil; linalool; linalyl acetate; LRG 201; 1-menthol; 2-methyl-3-(p-isopropylphenyl)propanal; 2-methyl-3-(p-t-butylphenyl)propanal; 3-methyl-2-pentyl-cyclopentanone; 3-methyl-5-phenyl-pentanol; alpha and beta methyl naphthyl ketones; methyl ionones; methyl dihydrojasmonate; methyl naphthyl ether; methyl 4-propyl phenyl ether; Mousse de chene Yugo; Musk ambrette; myrtenol; naroli oil; nonanediol-1;3-diacetate; nonanol; nonanolide-1,4, nopol acetate; 1,2,3,4,5,6,7,8-octahydro-2,3,8,8-tetramethyl-2-acetyl-naphthalene, available under the trademark "ISO-E-SUPER"; octanol; Oppoponax resinoid; orange oil; p-t-amylcyclohexanone; p-t-butylmethylhydrocinnamic aldehyde; 2-phenylethanol; 2-phenylethyl acetate; 2-phenylpropanol; 3-phenylpropanol; para-menthan-7-ol; para-t-butylphenyl methyl other; patchouli oil: pelargene; petitgrain oil; phenoxyethyl isobutyrate; phenylacetaldehyde diethyl acetal; phenylacetaldehyde dimethyl acetal; phenylethyl n-butyl ether; phenylethyl isoamyl ether; phenylethylphenyl acetate; pimento leaf oil; rose-d-oxide; Sandalone; styrallyl acetate) 1,1,4,4-tetramethyl-6-acetyl-7-ethyl-1,2,3,4-tetrahydronaphthalene, available under the trademark "VERSALIDE"; 3,3,5-trimethyl hexyl acetate; 3,5,5-trimethylcyclohexanol; terpineol; terpinyl acetate; tetrahydrogeraniol; tetrahydrolinalool; tetrahydromuguol; tetrahydromyrcenol; thyme oil; trichloromethylphenycarbinyl acetate; tricyclodecenyl acetate; tricyclodecenyl propionate; 10-undecen-1-al; gamma undecalactone; 10-undecen-1-ol undecanol; vanillin; vetiverol; vetiveryl acetate; vetyvert oil; acetate and propionate esters of alcohols in the list above; aromatic nitromusk fragrances; indane musk fragrances; isochroman musk fragrances; macrocyclic ketones; macrolactone musk fragrances; and tetralin musk fragrances. The perfumes can be used individually, or in combination in the detersive system.

Builders

Builders function as sequestering agents for divalent ions, thus preventing surfactant precipitation as Ca or Mg salts in areas of hard water. Suitable builders in the detersive system of the instant invention can include, but are not limited to, crystalline aluminosilicate, such as alkali metal aluminometasilicate and/or sodium aluminosilicate (zeolite), phosphate builders such as sodium tripolyphosphate, sodium orthophosphate or sodium pyrophosphate, inorganic builders such as sodium carbonate, layered silicate or amorphous aluminosilicate, organic builders such as polycarboxylate polymers including polyacrylates, acrylic/maleic copolymers, polyaspartates, monomeric polycarboxylates, citrates, gluconates, oxydisuccinates, glycerol mono-, di- or trisuccinates, carboxymethyloxysuccinates, carboxymethyloxymalaontes, dipicolinates, hydroxyethyliminodiacetates, alkyl-, alkenylmalonates, succinates, and sulphonated fatty acid salts. The builders may be used individually, or two or more in combination in the instant invention. Builders may be used in an amount of from about 0 to about.

EXAMPLES

I.

| Ingredients | Weight Percent |
|---|---|
| Sodium Percarbonate (bleach) | 0.022% |
| White Vinegar | 16.33% |
| Silky Pink ™ detergent | 72.63% |
| Water | balance |

In making the formulation, white vinegar is first added to the Silky Pink™ detergent, followed by the addition of sodium percarbonate. Water is then added.

II.

| Ingredients | Weight Percent |
|---|---|
| Sodium Percarbonate (bleach) | 1.71% |
| White Vinegar | 16.03% |
| Silky Pink ™ detergent | 71.58% |
| Water | balance |

The ingredients for II are mixed in a manner similar to Example I.

III.

| Ingredients | Weight Percent |
|---|---|
| Sodium Percarbonate | 4.94% |
| White Vinegar | 15.43% |
| Silky Pink ™ | 69.34% |
| water | balance |

The ingredients for III are mixed in a manner similar to Examples I and II.

Results

Comparing examples I, II, and III, it was determined that Example I provide the highest level of synergistic activity between the bleach and vinegar while avoiding a toxic amount of chloramine gas to be released.

I claim:

1. A detersive system for cleaning necessary areas and objects of focus for cleanliness, comprising:

a surfactant in a range of 60 to 75 weight percent;

a bleach selected from the group consisting of chlorine dioxide, sodium hypochlorite, calcium hypochlorite, bleach liquor, lime bleach liquor, bleaching powder, chlorinated lime, chloride of lime, dibasic magnesium hypochlorite, lithium hypochlorite, chlorinated trisodium phosphate, hypochlorous acid, oxidized chlorides, hypobomites, chlorinated isocyanurates, halogenated hydantoins, sodium N-chlorobenzenesulfonamide, sodium N-chloro-p-toluenesulfonamide, N-chlorosuccinimide, trichloromelamine, 1,3-dichlorotetrahydroquinazoline-2,4-dione, tetrachloroglycoluril, sodium trichlorometaphosphimate, sodium N-chloroimido-disulfonate, and N-chlorophenylbiquanidino, chlorine dioxide, hydrogen peroxide, sodium perborate, sodium carbonate peroxyhydrate, peroxymonosulfuric acid (Caro's Acid), potassium permonosulfate, and sodium percarbonate in a range of about 0.01 to about 6 weight percent;

a vinegar in a range of about 10 to about 20 weight percent; and water.

2. The detersive system of claim 1, wherein the surfactant is in a range of about 70 to about 73 weight percent.

3. The detersive system of claim 1, wherein the bleach is in a range of about 0.020 to about 4 weight percent.

4. The detersive system of claim 3, wherein the bleach is in a range of about 0.022 to about 2 weight percent.

5. The detersive system of claim 1, wherein the vinegar is in a range of about 15 to about 18 weight percent.

6. The detersive system of claim 5, wherein the vinegar is in a range of about 16 to about 17 weight percent.

7. The detersive system of claim 1, wherein the surfactant is selected from the group consisting of sodium octyl sulfate, sodium 2-ethyl hexyl sulfate, sodium decyl sulfate, sodium lauryl sulfate, sodium laureth sulfate, disodium lauryl sulfosuccinate, disodium laureth sulfosuccinate, ammonium lauryl sulfate, ammonium laureth sulfate, triethanolamine lauryl sulfate, triethanolamine laureth sulfite, monoethanolamine lauryl sulfite, monoethanolamine laureth sulfate, potassium lauryl sulfate, potassium laureth sulfate, magnesium lauryl sulfate, magnesium laureth sulfate, sodium nonyl phenol ether sulfate, sodium alph-olefin sulfonate, ethylene glycol monostearate, ethylene glycol distearate, and commercially available detergents.

8. The detersive system of claim 1, wherein the bleach is sodium percarbonate.

9. The detersive system of claim 1, wherein the vinegar is selected from the group consisting of cider vinegar, apple vinegar, white vinegar, malt vinegar, sugar vinegar, glucose vinegar, and spirit vinegar.

10. The detersive system of claim 1, wherein the vinegar is white vinegar.

11. The detersive system of claim 1, wherein the surfactant comprises two or more surfactants in combination.

12. The detersive system of claim 1, wherein the bleach comprises two or more bleaches in combination.

13. The detersive system of claim 1, wherein the vinegar comprises two or more vinegars used in combination.

14. A detersive system for cleaning necessary areas and objects of focus for cleanliness, comprising;

a commercially available detergent consisting of a surfactant, builders, foaming agents, emollients, and water in a range of about 70 to about 73 weight percent; sodium percarbonate in a range of about 0.022 to about 2 weight percent; white vinegar in a range of about 15 to about 18 weight percent; and water.

15. The detersive system of claim 1, further comprising one or more from the group consisting of builders, enzymes, foaming agents, emollients, antiredeposition agents, solvents, hydrotropes, fluorescers, foam boosters, foam controllers, sodium carbonate, sodium bicarbonate, sodium silicate, sodium sulphate, calcium chloride, and perfumes.

* * * * *